US010323537B2

(12) United States Patent
Jung

(10) Patent No.: US 10,323,537 B2
(45) Date of Patent: Jun. 18, 2019

(54) GAS TURBINE TIP CLEARANCE CONTROL ASSEMBLY

(71) Applicant: DOOSAN HEAVY INDUSTRIES & CONSTRUCTION CO., LTD., Gyeongsangnam-do (KR)

(72) Inventor: Sungchul Jung, Daejeon (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 389 days.

(21) Appl. No.: 15/205,781

(22) Filed: Jul. 8, 2016

(65) Prior Publication Data

US 2017/0096907 A1 Apr. 6, 2017

(30) Foreign Application Priority Data

Oct. 2, 2015 (KR) ..... 10-2015-0139134

(51) Int. Cl.
*F01D 5/02* (2006.01)
*F01D 11/22* (2006.01)
(Continued)

(52) U.S. Cl.
CPC ..... *F01D 11/22* (2013.01); *F01D 5/02* (2013.01); *F01D 5/225* (2013.01); *F01D 9/02* (2013.01);
(Continued)

(58) Field of Classification Search
CPC ..... F01D 11/08; F01D 11/12; F01D 11/122
See application file for complete search history.

(56) References Cited

U.S. PATENT DOCUMENTS 3,867,060 A * 2/1975 Huber ..... F01D 11/08 277/419
3,966,356 A * 6/1976 Irwin ..... F01D 11/08 415/173.3
(Continued)

FOREIGN PATENT DOCUMENTS

DE 01178253 B 9/1964
EP 2302167 A2 3/2011
(Continued)

OTHER PUBLICATIONS

An extended European Search Report issued by the European Patent Office and dated Mar. 21, 2017 in connection with the European Application No. 16179158.7, which corresponds to the above-referenced U.S. application.
(Continued)

*Primary Examiner* — Woody A Lee, Jr.
(74) *Attorney, Agent, or Firm* — INVENSTONE Patent, LLC

(57) ABSTRACT

The present disclosure relates to a tip clearance control assembly of a gas turbine including a casing, a plurality of blades, a labyrinth seal, and a shroud. The casing guides a flow of combustion gas. The plurality of blades is located inside the casing in such a manner as to be coupled to a rotary shaft of the gas turbine. The labyrinth seal is located at the front end portion of each blade. The shroud surrounds the front end portion of each blade. The casing includes an outer casing having dove tail slots and an inner ring segment having dove tail coupling portions, so that the dove tail coupling portions moves in an axial direction and a radial direction with respect to the gas turbine.

20 Claims, 3 Drawing Sheets

(51) Int. Cl.

| | |
|---|---|
| ***F01D 5/22*** | (2006.01) |
| ***F01D 9/02*** | (2006.01) |
| ***F01D 11/02*** | (2006.01) |
| ***F01D 11/12*** | (2006.01) |
| ***F01D 25/24*** | (2006.01) |

(52) U.S. Cl.
CPC ..... *F01D 11/02* (2013.01); *F01D 11/127* (2013.01); *F01D 25/24* (2013.01); *F05D 2220/32* (2013.01); *F05D 2240/11* (2013.01); *F05D 2240/20* (2013.01)

(56) References Cited

U.S. PATENT DOCUMENTS

| | | | | |
|---|---|---|---|---|
| 4,087,199 | A * | 5/1978 | Hemsworth | F01D 11/08 415/173.3 |
| 9,347,459 | B2 * | 5/2016 | Sheng | F04D 29/102 |
| 2002/0150469 | A1 | 10/2002 | Bolms | |
| 2014/0363283 | A1 * | 12/2014 | Guemmer | F01D 9/041 415/208.1 |
| 2015/0167488 | A1 | 6/2015 | Orosa | |
| 2016/0146053 | A1 * | 5/2016 | McCaffrey | F01D 25/246 415/173.1 |
| 2017/0218785 | A1 * | 8/2017 | Loiseau | F01D 11/005 |

FOREIGN PATENT DOCUMENTS

| | | | | |
|---|---|---|---|---|
| JP | 07-011908 | A | 1/1995 | |
| JP | 07-174001 | A | 7/1995 | |
| JP | 11-30338 | * | 7/1997 | F16J 15/447 |
| JP | 11-030338 | A | 2/1999 | |
| KR | 10-1509384 | B1 | 4/2015 | |

OTHER PUBLICATIONS

Office Action issued in corresponding Korean Application No. 10-2015-0139134, dated Jul. 28, 2016, 5 pages.

* cited by examiner

GAS TURBINE TIP CLEARANCE CONTROL ASSEMBLY

CROSS-REFERENCE TO RELATED APPLICATIONS

This application claims priority to Korean Application No. 10-2015-0139134, filed Oct. 2, 2015, the contents of which are incorporated herein in their entirety.

BACKGROUND

Generally, a gas turbine is one kind of turbo machines in which fuel is burnt by using high pressure compressed air and the high temperature and high pressure gas generated during the burning process is used to produce rotary power.

The gas turbine largely includes a compressor adapted to suck external air to provide a high pressure stream of air through compression of the sucked external air, a combustor adapted to mix fuel and the high pressure air compressed through the compressor and to burn the mixed fuel and air, and a turbine adapted to generate a rotary force for producing energy from the flow of high temperature and high pressure combustion gas discharged from the combustor.

Further, the leakage of combustion gas from the turbine to the outside, not via blades, gives substantially bad influences on the whole efficiency of an engine, and accordingly, it is important to solve the above-mentioned problem.

FIG. 1 shows a conventional gas turbine and the leakage deficiencies thereof. Referring to FIG. 1, a turbine 71 includes blades 75 rotating at a high speed with respect to a rotary shaft by means of a flow of combustion gas, and the leakage of the combustion gas is generated on a clearance between the free end portion of the blade 75 and a casing 77. The clearance is called a tip clearance G. The casing 77 includes an outer casing 77*a* having an inwardly bent groove formed thereon and an inner ring segment 77*b* having as shape coupled with the inwardly bent groove of the outer casing 77*a*.

On the other hand, the minimization of the tip clearance G is important to increase the efficiency of the gas turbine. By the way, if tolerances in the coupling between the outer casing 77*a* and the inner ring segment 77*b* are accumulated, it is hard to control the tip clearance G. If the tolerance occurs, that is, the outer casing 77*a* or the inner ring segment 77*b* itself should be machined again. In this case, the machining cost and time undesirably causes the loss in the whole process.

So as to control and minimize the tip clearance G, in conventional practices, the casing 77 itself is precisely machined. However, tolerance stacking occurs on the assembled parts, and further, it is impossible to additionally control the tip clearance G during the assembling process.

BRIEF SUMMARY

Accordingly, the present disclosure has been made in view of the above-mentioned problems occurring in the prior art and it is an object of the present disclosure to provide a tip clearance control assembly of a gas turbine that is capable of controlling a tip clearance between an inner ring segment and an outer casing through a shim located on the coupled portion between the inner ring segment and the outer casing and through inclined surfaces formed on the inner ring segment and the outer casing, thus reducing the manufacturing cost and time required for controlling the tip clearance in conventional practices.

To accomplish the above-mentioned object, according to a first aspect of the present disclosure, there is provided a tip clearance control assembly of a gas turbine including: a casing for guiding a flow of combustion gas; a plurality of blades located inside the casing in such a manner as to be coupled to a rotary shaft of the gas turbine; a labyrinth seal located at the front end portion of each blade in such a manner as to protrude from the outer surface thereof toward the inner peripheral surface of the casing; and a shroud for surrounding the front end portion of each blade, wherein the casing includes an outer casing having dove tail slots formed on the inner peripheral surface thereof and an inner ring segment having dove tail coupling portions formed on the outer peripheral surface thereof in such a manner as to correspond to the dove tail slots of the outer casing and the inner peripheral surface for surrounding the blades, so that the dove tail coupling portions slidingly move to the dove tail slots in an axial direction and a radial direction of the gas turbine.

According to the present disclosure, the inner ring segment further includes a honeycomb seal located on the inner peripheral surface thereof to set an appropriate clearance between the inner ring segment and the labyrinth seal.

According to the present disclosure, each dove tail slot includes: a radial slot surface formed to allow the inner ring segment and the outer casing supportingly face each other in the radial direction of the gas turbine; and an axial slot surface formed to allow the inner ring segment and the outer casing to supportingly face each other in the axial direction of the gas turbine.

According to the present disclosure, each dove tail coupling portion includes: a radial coupling surface formed correspondingly to the radial slot surface; and an axial coupling surface formed correspondingly to the axial slot surface.

According to the present disclosure, the radial slot surface is inclined toward the radial direction of the gas turbine along the axial direction of the gas turbine.

According to the present disclosure, each radial coupling surface is inclined in the radial direction of the gas turbine along the axial direction of the gas turbine.

According to the present disclosure, the axial slot surface includes a shim having given thickness in such a manner as to be supported against the axial slot surface and the axial coupling surface corresponding to the axial slot surface, and the inner ring segment is varied in position in accordance with the thicknesses of the shim.

To accomplish the above-mentioned object, according to a second aspect of the present disclosure, there is provided a method for controlling a tip clearance between a honeycomb seal and a labyrinth seal of a gas turbine, the method including the steps of: coupling an outer casing having dove tail slots formed on the inner peripheral surface thereof, the dove tail slots having inclined surfaces, to an inner ring segment having dove tail coupling portions formed on the outer peripheral surface thereof in such a manner as to correspond to the dove tail slots of the outer casing and the inner peripheral surface for surrounding a plurality of blades; and slidingly moving the dove tail coupling portions to the dove tail slots to control the position of the inner ring segment in an axial direction and a radial direction of the gas turbine.

According to the present disclosure, desirably, the method further includes, before the step of coupling the outer casing and the inner ring segment, the step of disposing a shim between an axial slot surface formed on the dove tail slot and an axial coupling surface formed on the dove tail coupling portion in such a manner as to correspond to the axial slot surface so that the shim supports the inner ring segment and the outer casing to allow the inner ring segment and the outer casing to face each other in the axial direction of the gas turbine.

BRIEF DESCRIPTION OF THE DRAWINGS

The above and other objects, features and advantages of the present disclosure will be apparent from the following detailed description of the preferred embodiments of the disclosure in conjunction with the accompanying drawings, in which.

DETAILED DESCRIPTION

Figure 1:
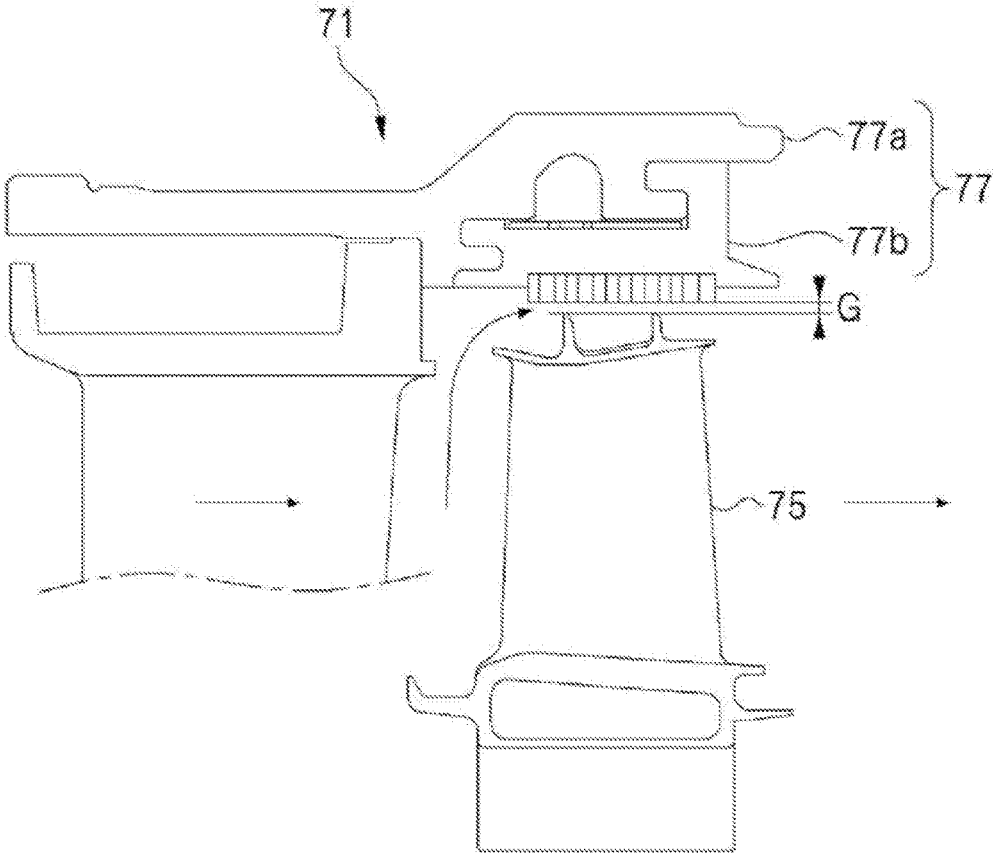
FIG. 1 is a sectional view showing an outer casing and an inner ring segment in a conventional practice.

Hereinafter, an explanation on a tip clearance control assembly of a gas turbine according to the present disclosure will be in detail given with reference to the attached drawing. The present disclosure is disclosed with reference to the attached drawings. Corresponding parts in the embodiments of the present disclosure are indicated by corresponding reference numerals and redundant explanation of the corresponding pails have been omitted for clarity.

Terms, such as "first", "second", "A", and "B", may be used to describe various elements, but the elements should not be restricted by the terms. The terns are used to only distinguish one element from the other element For example, a first element may be named a second element without departing from the scope of the present disclosure. Likewise, a second element may be named a first element. A term 'and/or' includes a combination of a plurality of relevant and described items or any one of a plurality of related and described items. When it is said that one element is described as being "connected" or "coupled" to the other element, one element may be directly connected or coupled to the other element, but it should be understood that another element may be present between the two elements. In contrast, when it is said that one element is described as being "directly connected" or "directly coupled" to the other element, it should be understood that another element is not present between the two elements.

Figure 2:
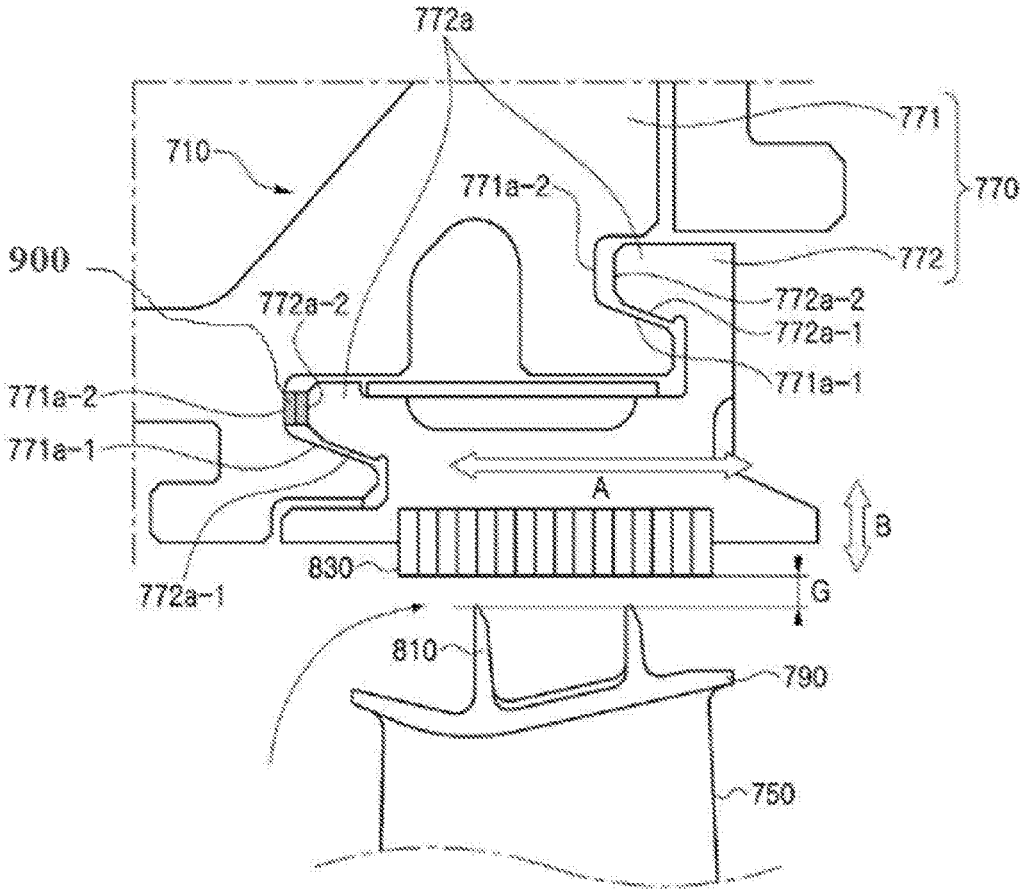
FIG. 2 is a sectional view showing a tip clearance control assembly of a gas turbine according to the present disclosure.

FIG. 2 is a sectional view showing a tip clearance control assembly of a gas turbine according to the present disclosure.

As shown in FIG. 2, a tip clearance control assembly of a gas turbine according to the present disclosure includes a casing 770 for guiding a flow of combustion gas, a plurality of blades 750 located inside the casing 770 and coupled to a rotary shaft of the gas turbine 710, a labyrinth seal 810 located at the front end portion of each blade 750 in such a manner as to protrude from the outer surface thereof toward the inner peripheral surface of the casing 770, and a shroud 790 for surrounding the front end portion of each blade 750.

The casing 770 includes an outer casing 771 and an inner ring segment 772. The outer casing 771 includes dove tail slots 771*a* formed on the inner peripheral surface thereof, and the inner ring segment 772 includes dove tail coupling portions 772*a* formed on the outer peripheral surface. The dove tail coupling portions 772*a* correspond to the dove tail slots 771*a* of the outer casing 771 and the inner peripheral surface for surrounding the blades 750 so that the dove tail coupling portions 772*a* is slidingly movable with respect to the dove tail slots 771*a* in an axial direction A and a radial direction B. Specifically, the structural characteristics of the present disclosure allows the dove tail coupling portions 772*a* to slidingly move in both the axial direction A and the radial direction B of the gas turbine 710. Moreover, the dove tail coupling portions 772*a* may also move in a diagonal direction, relative to axial direction A and radial direction B. Terms relevant to the dove tail slots 771*a* and the dove tail coupling portions 772 are intended to convey a meaning of having a shape consistent with either symmetrical half of a traditional dovetail configuration.

Additionally, the inner ring segment 772 may include a honeycomb seal 830 located on the inner peripheral surface thereof to set an appropriate clearance between the inner ring segment 772 and the labyrinth seal 810. The honeycomb seal 830 and the labyrinth seal 810 may have the same configurations as in a conventional gas turbine.

Each dove tail slot 771*a* may include a radial slot surface 771*a*-1 formed to allow the inner ring segment 772 and the outer casing 771 to supportingly face each other in the radial direction B of the gas turbine 710. Each dove tail slot 771*a* may also include an axial slot surface 771*a*-2 formed to allow the inner ring segment 772 and the outer casing 771 to supportingly face each other in the axial direction A of the gas turbine 710.

Each dove tail coupling portion 772*a* may include a radial coupling surface 772*a*-1 formed correspondingly to the radial slot surface 771*a*-1, and an axial coupling surface 772*a*-2 formed correspondingly to the axial slot surface 771*a*-2.

The radial slot surface 771*a*-1 may be inclined toward the radial direction B of the gas turbine 710 along the axial direction A of the gas turbine 710. In other words, the radial slot surface 771*a*-1 may be disposed diagonally relative to the axial direction A and radial direction B. In this case, even if the radial coupling surfaces 772*a*-1 are parallel to the axial direction A and are therefore not inclined, the diagonally disposed radial slot surfaces 771*a*-1 allow the dove tail coupling portions 772*a* to slidingly move in both the radial direction B of the gas turbine 710 and axial direction A of the gas turbine 710. In the conventional practice, the radial slot surface 771*a*-1 is perpendicular to the radial direction B of the gas turbine 710 along the axial direction A of the gas turbine 710, while being not inclinedly formed. Further in the conventional practice, the radial coupling surface 772*a*-1 is perpendicular to the radial direction B of the gas turbine 710 along the axial direction A of the gas turbine 710, while being not inclinedly formed.

In the conventional practice, accordingly, when the tip clearance G occurs after the dove tail coupling has finished though the coupling between the outer casing 77*a* and the inner ring segment 77*b*, the inner ring segment 77*b* cannot move in the axial direction A or the radial direction B of the gas turbine 71. So as to control the tip clearance G again, accordingly, the outer casing 77*a* or the inner ring segment 77*b* itself should be machined again. In this case, the machining cost and time are additionally increased.

Furthermore, when the dove tail coupling portions 772*a* and the dove tail slots 771*a* are coupled to each other, a given gap between each axial slot surface 771*a*-2 and each axial coupling surface 772*a*-2 is generated.

Accordingly, each radial coupling surface 772*a*-1 and each radial slot surface 771*a*-1 have corresponding inclined surfaces to each other, so that the inner ring segment 772 slidingly moves in the axial direction A and the radial direction B of the gas turbine 710.

Since the inner ring segment 772 slidingly moves in the axial direction A and the radial direction B of the gas turbine 710, the tip clearance G between the inner ring segment 772 and the blades 750 may be controlled.

In an alternative embodiment, the axial slot surface 771*a*-2 includes a shim 900 having a certain thickness as to be supported against the axial slot surface 771*a*-2 and the corresponding axial coupling surface 772*a*-2. The position of the inner ring segment 772 may be varied according to the thicknesses of the shim 900.

When it is necessary to control the tip clearance G When the inner ring segment 772 and the outer casing 771 are coupled, the shim 900 having an appropriate thickness is interposed between each axial slot surface 771*a*-2 and each axial coupling surface 772*a*-2. The shim provides a degree of sliding movement of the inner ring segment 772 that is regulated to control the tip clearance G between the blades 750 and the inner ring segment 772.

Figure 3:
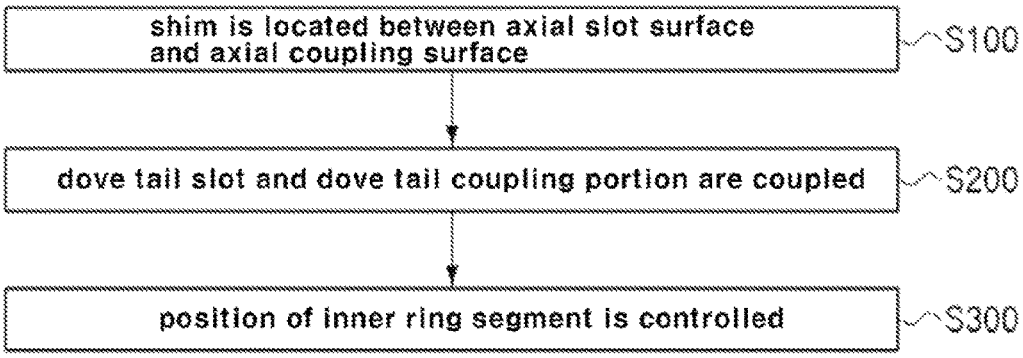
FIG. 3 is a flowchart showing a method for controlling a tip clearance between a honeycomb seal and a labyrinth seal of the tip clearance control assembly according to the present disclosure.

FIG. 3 is a flowchart showing the method for controlling the tip clearance between the honeycomb seal and the labyrinth seal of the tip clearance control assembly of the gas turbine according to the present disclosure.

According to the present disclosure, as shown in FIG. 3, a method for controlling a tip clearance G between a honeycomb seal 830 and a labyrinth seal 810 of a gas turbine 710 includes the steps of coupling an outer casing 771 having dove tail slots 771*a* formed on the inner peripheral surface thereof the dove tail slots 771*a* having inclined surfaces, to an inner ring segment 772 having dove tail coupling portions 772*a* formed on the outer peripheral surface thereof in such a manner as to correspond to the dove tail slots 771*a* of the outer casing 771 and the inner peripheral surface for surrounding the blades 750 (at step S200); and slidingly moving the dove tail coupling portions 772*a* to the dove tail slots 771*a* to control the position of the inner ring segment 772 in an axial direction A and a radial direction B of the gas turbine 710 (at step S300).

Before the step of coupling the outer casing 771 and the inner ring segment 772, further, the method according to the present disclosure further includes the step of disposing a shim 900 between an axial slot surface 771*a*-2 formed on the dove tail slot 771*a* and an axial coupling surface 772*a*-2 formed on the dove tail coupling portion 772*a* in such a manner as to correspond to the axial slot surface 771*a*-2 (at step S100) so that the shim 900 supports the inner ring segment 772 and the outer casing 771 to allow the inner ring segment 772 and the outer casing 771 to face each other in the axial direction A of the gas turbine 710.

Through the above-mentioned steps, that is, the thickness of the shim 900 is just controlled, thus reducing the manufacturing cost and time additionally needed for controlling the tip clearance again after the outer casing 77*a* and the inner ring segment 77*b* are coupled to each other in the conventional practice.

As described above, the tip clearance control assembly of the gas turbine according to the present disclosure can control the tip clearance between the inner ring segment and the outer casing through the shim located on the coupled portion between the inner ring segment and the outer casing and through the inclined surfaces formed on the inner ring segment and the outer casing, thus reducing the manufacturing cost and time required for controlling the tip clearance.

In the above, terms used in this application are used to only describe specific exemplary embodiments and are not intended to restrict the present disclosure. An expression referencing a singular value additionally refers to a corresponding expression of the plural number, unless explicitly limited otherwise by the context. In this application, terms, such as "comprise", "include", or "have", are intended to designate those characteristics, numbers, steps, operations, elements, or parts which are described in the specification, or any combination of them that exist, and it should be understood that they do not preclude the possibility of the existence or possible addition of one or more additional characteristics, numbers, steps, operations, elements, or parts, or combinations thereof.

While the present disclosure has been described with reference to the particular illustrative embodiments, it is not to be restricted by the embodiments but only by the appended claims. It is to be appreciated that those skilled in the art can change or modify the embodiments without departing from the scope and spirit of the present disclosure.

Further, the embodiments discussed have been presented by way of example only and not limitation. Thus, the breadth and scope of the invention(s) should not be limited by any of the above-described exemplary embodiments, but should be defined only in accordance with the following claims and their equivalents. Moreover, the above advantages and features are provided in described embodiments, but shall not limit the application of the claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, although the headings refer to a "Technical Field," the claims should not be limited by the language chosen under this heading to describe the so-called technical field. Further, a description of a technology in the "Background" is not to be construed as an admission that technology is prior art to any invention(s) in this disclosure. Neither is the "Brief Summary" to be considered as a characterization of the invention(s) set forth in the claims found herein. Furthermore, any reference in this disclosure to "invention" in the singular should not be used to argue that there is only a single point of novelty claimed in this disclosure. Multiple inventions may be set forth according to the limitations of the multiple claims associated with this disclosure, and the claims accordingly define the invention(s), and their equivalents, that are protected thereby. In all instances, the scope of the claims shall be considered on their own merits in light of the specification, but should not be constrained by the headings set forth herein.

What is claimed is:

1. A tip clearance control assembly, comprising:

a casing configured to guide a flow of combustion gas in an axial direction of a gas turbine, the casing including:

an inner ring segment having a dove tail coupling portion formed of a radial coupling surface communicating with an axial coupling surface facing in the axial direction, and an outer casing having a dove tail slot configured to receive the dove tail coupling portion and formed of a radial slot surface communicating with an axial slot surface facing in the axial direction;

a honeycomb seal disposed on an inner peripheral surface of the inner ring;

a labyrinth seal disposed on each of a plurality of blades coupled to a rotary shaft of the gas turbine in a radial direction, the labyrinth seal protruding toward the inner peripheral surface of the inner ring; and a shim interposed between the axial slot surface and the axial coupling surface, the shim having a predetermined thickness for setting a tip clearance between the honeycomb seal and the labyrinth seal.

2. The tip clearance control assembly according to claim 1, wherein the inner ring segment is movable in the axial and radial directions.

3. The tip clearance control assembly according to claim 1, wherein the predetermined thickness of the shim sets a position of the inner ring segment relative to the outer casing.

4. The tip clearance control assembly according to claim 1, wherein the radial slot surface is inclined with respect to the radial direction.

5. The tip clearance control assembly according to claim 4, wherein the radial coupling surface is parallel to the radial direction.

6. The tip clearance control assembly according to claim 4, wherein the radial coupling surface corresponds to radial slot surface.

7. The tip clearance control assembly according to claim 1, wherein the dove tail coupling portion is coupled to the dove tail slot in the axial direction.

8. The tip clearance control assembly according to claim 7, wherein the tip clearance is set when the dove tail coupling portion is coupled to the dove tail slot.

9. The tip clearance control assembly according to claim 1, wherein the shim consists of a plurality of shims having a combined thickness for setting the tip clearance between the honeycomb seal and the labyrinth seal.

10. The tip clearance control assembly according to claim 1, wherein the dove tail coupling portion consists of a plurality of dove tail coupling portions, and the dove tail slot consists of a plurality of dove tail slots including one dove tail slot that is closer to the honeycomb seal than another, and wherein the shim is disposed in the one dove tail slot.

11. The tip clearance control assembly according to claim 1, wherein the inner ring segment is supported on the outer casing by way of the interposed shim.

12. The tip clearance control assembly according to claim 1, wherein the labyrinth seal is disposed on a front end portion of each blade so as to face the honeycomb seal.

13. A tip clearance control assembly, comprising:

a casing configured to guide a flow of combustion gas in an axial direction of a gas turbine, the casing including:

an inner ring segment having a dove tail coupling portion formed of a radial coupling surface communicating with an axial coupling surface facing in the axial direction, and an outer casing having a dove tail slot configured to receive the dove tail coupling portion and formed of a radial slot surface communicating with an axial slot surface facing in the axial direction;

a honeycomb seal disposed on an inner peripheral surface of the inner ring;

a labyrinth seal disposed on each of a plurality of blades coupled to a rotary shaft of the gas turbine in a radial direction, the labyrinth seal protruding toward the inner peripheral surface of the inner ring; and a shim interposed between the axial slot surface and the axial coupling surface, the shim having a predetermined thickness for setting a position of the inner ring segment relative to the outer casing.

14. The tip clearance control assembly according to claim 13, wherein the inner ring segment is movable in the axial and radial directions.

15. A method for controlling a tip clearance in a gas turbine comprising:

a casing configured to guide a flow of combustion gas in an axial direction of the gas turbine, the casing including an inner ring segment having a dove tail coupling portion formed of a radial coupling surface communicating with an axial coupling surface facing in the axial direction, and an outer casing having a dove tail slot configured to receive the dove tail coupling portion and formed of a radial slot surface communicating with an axial slot surface facing in the axial direction;

a honeycomb seal disposed on an inner peripheral surface of the inner ring; and a labyrinth seal disposed on each of a plurality of blades coupled to a rotary shaft of the gas turbine in a radial direction, the labyrinth seal protruding toward the inner peripheral surface of the inner ring, wherein the method comprises:

coupling the dove tail slot to the dove tail coupling portion; and wherein a position of the inner ring segment relative to the outer casing during operation of the gas turbine is variable by allowing the radial coupling surface to slide against the radial slot surface of the dove tail coupling portion coupled to the dove tail slot.

16. The method according to claim 15, wherein the sliding allows the inner ring segment to move in the axial and radial directions.

17. The method according to claim 15, further comprising:

interposing a shim between the dove tail slot and the dove tail coupling portion before coupling the dove tail slot to the dove tail coupling portion, such that the shim is disposed between the axial slot surface and the axial coupling surface.

18. The method according to claim 17, wherein the shim interposing comprises setting the tip clearance based on a predetermined thickness of the shim.

19. The method according to claim 17, wherein the shim interposing comprises setting the position of the inner ring segment relative to the outer casing based on a predetermined thickness of the shim.

20. The method according to claim 17, wherein the shim interposing comprises interposing a plurality of shims between the dove tail slot and the dove tail coupling portion, such that the plurality of shims have a combined thickness for setting the position of the inner ring segment relative to the outer casing.

* * * * *